US006281461B1

(12) United States Patent
Doughty

(10) Patent No.: US 6,281,461 B1
(45) Date of Patent: Aug. 28, 2001

(54) CIRCUIT BREAKER ROTOR ASSEMBLY HAVING ARC PREVENTION STRUCTURE

(75) Inventor: Dennis J. Doughty, Plainville, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/472,559

(22) Filed: Dec. 27, 1999

(51) Int. Cl.[7] ..... H01H 3/00

(52) U.S. Cl. ..... 218/154; 335/16; 335/147; 335/195

(58) Field of Search ..... 200/237–250, 200/17 R, 18, 287, 288, 274, 336, 400; 335/8–10, 16, 147, 167, 195, 201, 202; 218/22, 31, 32, 152, 154

(56) References Cited

U.S. PATENT DOCUMENTS

| | | | | |
|---|---|---|---|---|
| D. 367,265 | | 2/1996 | Yamagata et al. | D13/160 |
| 2,340,682 | | 2/1944 | Powell | 200/147 |
| 2,719,203 | | 9/1955 | Gelzheiser et al. | 200/144 |
| 2,937,254 | | 5/1960 | Ericson | 200/114 |
| 3,158,717 | | 11/1964 | Jencks et al. | 200/116 |
| 3,162,739 | | 12/1964 | Klein et al. | 200/88 |
| 3,197,582 | | 7/1965 | Norden | 200/50 |
| 3,307,002 | | 2/1967 | Cooper | 200/116 |
| 3,517,356 | | 6/1970 | Hanafusa | 335/16 |
| 3,617,672 | * | 11/1971 | Atakkaan | 200/240 |
| 3,631,369 | | 12/1971 | Menocal | 337/110 |
| 3,803,455 | | 4/1974 | Willard | 317/33 SC |
| 3,883,781 | | 5/1975 | Cotton | 317/14 R |
| 3,937,911 | | 2/1976 | Mabuchi et al. . | |
| 4,129,762 | | 12/1978 | Bruchet | 200/153 G |
| 4,144,513 | | 3/1979 | Shafer et al. | 335/46 |
| 4,158,119 | | 6/1979 | Krakik | 200/240 |
| 4,165,453 | | 8/1979 | Hennemann | 200/153 G |
| 4,166,988 | | 9/1979 | Ciarcia et al. | 335/9 |
| 4,220,934 | | 9/1980 | Wafer et al. | 335/16 |
| 4,255,732 | | 3/1981 | Wafer et al. | 335/16 |
| 4,259,651 | | 3/1981 | Yamat | 335/16 |
| 4,263,492 | | 4/1981 | Maier et al. | 200/288 |
| 4,276,527 | | 6/1981 | Gerbert-Gaillard et al. | 335/39 |
| 4,297,663 | | 10/1981 | Seymour et al. | 335/20 |
| 4,301,342 | | 11/1981 | Castonguay et al. | 200/153 SC |
| 4,360,852 | | 11/1982 | Gilmore | 361/98 |
| 4,368,444 | | 1/1983 | Preuss et al. | 335/166 |
| 4,375,021 | | 2/1983 | Pardini et al. . | |
| 4,375,022 | | 2/1983 | Daussin et al. | 200/148 R |
| 4,376,270 | | 3/1983 | Staffen | 335/21 |
| 4,383,146 | | 5/1983 | Bur | 200/17 R |
| 4,392,036 | | 7/1983 | Troebel et al. | 200/322 |
| 4,393,283 | | 7/1983 | Masuda | 200/51.09 |
| 4,401,872 | | 8/1983 | Boichet-Castagne et al. | 200/153 G |
| 4,409,573 | | 10/1983 | DiMarco et al. | 335/16 |
| 4,435,690 | | 3/1984 | Link et al. | 335/37 |

(List continued on next page.)

FOREIGN PATENT DOCUMENTS

| | | |
|---|---|---|
| 819 008 | 12/1974 | (BE) . |
| 897 691 | 1/1984 | (BE) . |
| 12 27 978 | 11/1966 | (DE) . |
| 30 47 360 | 6/1982 | (DE) . |
| 38 02 184 | 8/1989 | (DE) . |
| 38 43 277 | 6/1990 | (DE) . |
| 44 19 240 | 1/1995 | (DE) . |

(List continued on next page.)

*Primary Examiner*—J. R. Scott
(74) *Attorney, Agent, or Firm*—Cantor Colburn LLP; Carl B. Horton

(57) ABSTRACT

A rotor spring insulator assembly comprises a base member having a D-shaped opening therein and a connecting rod of a D-shaped cross section dimensioned to be received in the D-shaped opening of the base member. The flat edge of the D-shaped connecting rod faces a spring of a rotor thereby maximizing the distance and the amount of insulative material between the connecting rod and the spring to minimize the chance that arcing will occur between the connecting rod and the spring.

5 Claims, 3 Drawing Sheets

U.S. PATENT DOCUMENTS

| | | | | |
|---|---|---|---|---|
| 4,467,297 | | 8/1984 | Boichet-Castagne et al. | 335/8 |
| 4,468,645 | | 8/1984 | Gerbert-Gaillard et al. | 335/42 |
| 4,470,027 | | 9/1984 | Link et al. | 335/16 |
| 4,479,143 | | 10/1984 | Watanabe et al. | 358/44 |
| 4,488,133 | | 12/1984 | McClellan et al. | 335/16 |
| 4,492,941 | | 1/1985 | Nagel | 335/13 |
| 4,541,032 | | 9/1985 | Schwab | 361/331 |
| 4,546,224 | | 10/1985 | Mostosi | 200/153 G |
| 4,550,360 | | 10/1985 | Dougherty | 361/93 |
| 4,562,419 | | 12/1985 | Preuss et al. | 335/195 |
| 4,589,052 | | 5/1986 | Dougherty | 361/94 |
| 4,595,812 | | 6/1986 | Tamaru et al. | 200/307 |
| 4,611,187 | | 9/1986 | Banfi | 335/16 |
| 4,612,430 | | 9/1986 | Sloan et al. | 200/327 |
| 4,616,198 | | 10/1986 | Pardini | 335/16 |
| 4,622,444 | | 11/1986 | Kandatsu et al. | 200/303 |
| 4,631,625 | | 12/1986 | Alexander et al. | 361/94 |
| 4,642,431 | | 2/1987 | Tedesco et al. | 200/153 G |
| 4,644,438 | | 2/1987 | Puccinelli et al. | 361/75 |
| 4,649,247 | | 3/1987 | Preuss et al. | 200/244 |
| 4,658,322 | | 4/1987 | Rivera | 361/37 |
| 4,672,501 | | 6/1987 | Bilac et al. | 361/96 |
| 4,675,481 | | 6/1987 | Markowski et al. | 200/144 R |
| 4,682,264 | | 7/1987 | Demeyer | 361/96 |
| 4,689,712 | | 8/1987 | Demeyer | 361/96 |
| 4,694,373 | | 9/1987 | Demeyer | 361/96 |
| 4,710,845 | | 12/1987 | Demeyer | 361/96 |
| 4,717,985 | | 1/1988 | Demeyer | 361/96 |
| 4,733,211 | | 3/1988 | Castonguay et al. | 335/192 |
| 4,733,321 | | 3/1988 | Lindeperg | 361/96 |
| 4,760,278 | | 7/1988 | Thomson . | |
| 4,764,650 | | 8/1988 | Bur et al. | 200/153 G |
| 4,768,007 | | 8/1988 | Mertz et al. | 335/202 |
| 4,780,786 | | 10/1988 | Weynachter et al. | 361/87 |
| 4,831,221 | | 5/1989 | Yu et al. | 200/553 |
| 4,870,531 | | 9/1989 | Danek | 361/93 |
| 4,883,931 | | 11/1989 | Batteux et al. | 200/148 R |
| 4,884,047 | | 11/1989 | Baginski et al. | 335/10 |
| 4,884,164 | | 11/1989 | Dzuira et al. | 361/97 |
| 4,900,882 | | 2/1990 | Bernard et al. | 200/147 R |
| 4,910,485 | * | 3/1990 | Bolongeat-Mobleu et al. | 335/195 |
| 4,914,541 | | 4/1990 | Tripodi et al. | 361/94 |
| 4,916,420 | | 4/1990 | Bartolo et al. | 335/172 |
| 4,916,421 | | 4/1990 | Pardini et al. | 335/185 |
| 4,926,282 | | 5/1990 | McGhie | 361/102 |
| 4,935,590 | | 6/1990 | Malkin et al. | 200/148 A |
| 4,937,706 | | 6/1990 | Schueller et al. | 361/396 |
| 4,939,492 | | 7/1990 | Raso et al. | 335/42 |
| 4,943,691 | | 7/1990 | Mertz et al. | 200/151 |
| 4,943,888 | | 7/1990 | Jacob et al. | 361/96 |
| 4,950,855 | | 8/1990 | Bolonegeat-Mobleu et al. | 200/148 A |
| 4,951,019 | | 8/1990 | Gula | 335/166 |
| 4,952,897 | | 8/1990 | Barnel et al. | 335/147 |
| 4,958,135 | | 9/1990 | Baginski et al. | 335/8 |
| 4,965,543 | | 10/1990 | Batteux | 335/174 |
| 4,970,482 | | 11/1990 | Jacobs et al. . | |
| 4,983,788 | | 1/1991 | Pardini | 200/16 R |
| 5,001,313 | | 3/1991 | Leclerq et al. | 200/148 B |
| 5,003,139 | | 3/1991 | Edds et al. . | |
| 5,004,878 | | 4/1991 | Seymour et al. | 200/144 R |
| 5,029,301 | | 7/1991 | Nebon et al. | 335/16 |
| 5,030,804 | | 7/1991 | Abri | 200/323 |
| 5,057,655 | | 10/1991 | Kersusan et al. | 200/148 B |
| 5,077,627 | | 12/1991 | Fraisse | 361/93 |
| 5,083,081 | | 1/1992 | Barrault et al. | 324/126 |
| 5,095,183 | | 3/1992 | Raphard et al. | 200/148 A |
| 5,103,198 | | 4/1992 | Morel et al. | 335/6 |
| 5,115,371 | | 5/1992 | Tripodi | 361/106 |
| 5,120,921 | | 6/1992 | DiMarco et al. | 200/401 |
| 5,132,865 | | 7/1992 | Mertz et al. | 361/6 |
| 5,138,121 | | 8/1992 | Streich et al. | 200/293 |
| 5,140,115 | | 8/1992 | Morris | 200/308 |
| 5,153,802 | | 10/1992 | Mertz et al. | 361/18 |
| 5,155,315 | | 10/1992 | Malkin et al. | 200/148 R |
| 5,166,483 | | 11/1992 | Kersusan et al. | 200/144 A |
| 5,172,087 | | 12/1992 | Castonguay et al. | 335/160 |
| 5,178,504 | | 1/1993 | Falchi | 411/553 |
| 5,184,717 | | 2/1993 | Chou et al. | 200/401 |
| 5,187,339 | | 2/1993 | Lissandrin | 200/148 F |
| 5,198,956 | | 3/1993 | Dvorak | 361/106 |
| 5,200,724 | | 4/1993 | Gula et al. | 335/166 |
| 5,210,385 | | 5/1993 | Morel et al. | 200/146 R |
| 5,239,150 | | 8/1993 | Bolongeat-Mobleu et al. | 200/148 R |
| 5,260,533 | | 11/1993 | Livesey et al. | 200/401 |
| 5,262,744 | | 11/1993 | Arnold et al. | 335/8 |
| 5,280,144 | | 1/1994 | Bolongeat-Mobleu et al. | 200/148 R |
| 5,281,776 | | 1/1994 | Morel et al. | 200/144 |
| 5,296,660 | | 3/1994 | Morel et al. | 200/146 R |
| 5,296,664 | | 3/1994 | Crookston et al. | 200/401 |
| 5,298,874 | | 3/1994 | Morel et al. | 335/8 |
| 5,300,907 | | 4/1994 | Nereau et al. | 335/172 |
| 5,310,971 | | 5/1994 | Vial et al. . | |
| 5,313,180 | * | 5/1994 | Vial et al. | 218/31 X |
| 5,317,471 | | 5/1994 | Izoard et al. | 361/105 |
| 5,331,500 | | 7/1994 | Corcoles et al. | 361/93 |
| 5,334,808 | | 8/1994 | Bur et al. | 200/50 |
| 5,341,191 | | 8/1994 | Crookston et al. | 335/16 |
| 5,347,096 | | 9/1994 | Bolongeat-Mobleu et al. | 200/148 B |
| 5,347,097 | | 9/1994 | Bolongeat-Mobleu et al. | 200/148 B |
| 5,350,892 | | 9/1994 | Rozier | 200/144 B |
| 5,357,066 | * | 10/1994 | Morel et al. | 200/17 R |
| 5,357,068 | | 10/1994 | Rozier | 200/148 R |
| 5,357,394 | | 10/1994 | Piney | 361/72 |
| 5,361,052 | | 11/1994 | Ferullo et al. | 335/172 |
| 5,373,130 | | 12/1994 | Barrault et al. | 200/147 R |
| 5,379,013 | | 1/1995 | Coudert | 335/17 |
| 5,424,701 | | 6/1995 | Castonguary et al. | 335/172 |
| 5,438,176 | | 8/1995 | Bonnardel et al. | 200/400 |
| 5,440,088 | | 8/1995 | Coudert et al. | 200/303 |
| 5,449,871 | | 9/1995 | Batteux et al. | 200/401 |
| 5,450,048 | | 9/1995 | Leger et al. | 335/132 |
| 5,451,729 | | 9/1995 | Onderka et al. | 200/18 |
| 5,457,295 | | 10/1995 | Tanibe et al. | 200/293 |
| 5,467,069 | | 11/1995 | Payet-Burin et al. | 335/42 |
| 5,469,121 | | 11/1995 | Payet-Burin | 335/16 |
| 5,475,558 | | 12/1995 | Barjonnet et al. | 361/64 |
| 5,477,016 | | 12/1995 | Baginski et al. | 200/43.11 |
| 5,479,143 | | 12/1995 | Payet-Burin | 335/202 |
| 5,483,212 | | 1/1996 | Lankuttis et al. | 335/132 |
| 5,485,343 | | 1/1996 | Santos et al. | 361/115 |
| 5,493,083 | | 2/1996 | Olivier | 200/17 R |
| 5,504,284 | | 4/1996 | Lazareth et al. | 200/50 R |
| 5,504,290 | | 4/1996 | Baginski et al. | 200/401 |
| 5,510,761 | | 4/1996 | Boder et al. | 335/172 |
| 5,512,720 | | 4/1996 | Coudert et al. | 200/400 |
| 5,515,018 | | 5/1996 | DiMarco et al. | 335/16 |
| 5,519,561 | | 5/1996 | Mrenna et al. | 361/105 |
| 5,534,674 | | 7/1996 | Steffens et al. | 218/154 |
| 5,534,832 | | 7/1996 | Duchemin et al. | 335/16 |
| 5,534,835 | | 7/1996 | McColloch et al. | 335/172 |
| 5,534,840 | | 7/1996 | Cuingnet | 337/1 |
| 5,539,168 | | 7/1996 | Linzenich | 200/303 |
| 5,539,370 | | 7/1996 | Arnold . | |
| 5,543,595 | | 8/1996 | Mader et al. | 200/401 |
| 5,552,755 | | 9/1996 | Fello et al. | 335/18 |
| 5,581,219 | | 12/1996 | Nozawa et al. | 335/132 |
| 5,604,656 | | 2/1997 | Derrick et al. | 361/187 |
| 5,608,367 | | 3/1997 | Zoller et al. | 335/132 |
| 5,784,233 | | 7/1998 | Bastard et al. | 361/36 |
| 5,877,467 | | 3/1999 | Arnold et al. . | |

| | | | | |
|---|---|---|---|---|
| 5,969,308 | | 10/1999 | Pever . | |
| 6,084,489 | * | 7/2000 | Castonguay et al. | 335/167 |
| 6,114,641 | * | 9/2000 | Castonguay et al. | 200/244 |

FOREIGN PATENT DOCUMENTS

| | | |
|---|---|---|
| 0 061 092 | 9/1982 | (EP) . |
| 0 064 906 | 11/1982 | (EP) . |
| 0 066 486 | 12/1982 | (EP) . |
| 0 076 719 | 4/1983 | (EP) . |
| 0 117 094 | 8/1984 | (EP) . |
| 0 140 761 | 5/1985 | (EP) . |
| 0 174 904 | 3/1986 | (EP) . |
| 0 196 241 | 10/1986 | (EP) . |
| 0 224 396 | 6/1987 | (EP) . |
| 0 235 479 | 9/1987 | (EP) . |
| 0 239 460 | 9/1987 | (EP) . |
| 0 258 090 | 3/1988 | (EP) . |
| 0 264 313 | 4/1988 | (EP) . |
| 0 264 314 | 4/1988 | (EP) . |
| 0 283 189 | 9/1988 | (EP) . |
| 0 283 358 | 9/1988 | (EP) . |
| 0 291 374 | 11/1988 | (EP) . |
| 0 295 155 | 12/1988 | (EP) . |
| 0 295 158 | 12/1988 | (EP) . |
| 0 309 923 | 4/1989 | (EP) . |
| 0 313 106 | 4/1989 | (EP) . |
| 0 313 422 | 4/1989 | (EP) . |
| 0 314 540 | 5/1989 | (EP) . |
| 0 331 586 | 9/1989 | (EP) . |
| 0 337 900 | 10/1989 | (EP) . |
| 0 342 133 | 11/1989 | (EP) . |
| 0 367 690 | 5/1990 | (EP) . |
| 0 371 887 | 6/1990 | (EP) . |
| 0 375 568 | 6/1990 | (EP) . |
| 0 394 144 | 10/1990 | (EP) . |
| 0 394 922 | 10/1990 | (EP) . |
| 0 399 282 | 11/1990 | (EP) . |
| 0 407 310 | 1/1991 | (EP) . |
| 0 452 230 | 10/1991 | (EP) . |
| 0 555 158 | 8/1993 | (EP) . |
| 560697 | 9/1993 | (EP) . |
| 0 567 416 | 10/1993 | (EP) . |
| 0 595 730 | 5/1994 | (EP) . |
| 0 619 591 | 10/1994 | (EP) . |
| 0 665 569 | 8/1995 | (EP) . |
| 0 700 140 | 3/1996 | (EP) . |
| 889498 | 1/1999 | (EP) . |
| 2 410 353 | 6/1979 | (FR) . |
| 2 512 582 | 3/1983 | (FR) . |
| 2 553 943 | 4/1985 | (FR) . |
| 2 592 998 | 7/1987 | (FR) . |
| 2 682 531 | 4/1993 | (FR) . |
| 2 697 670 | 5/1994 | (FR) . |
| 2 699 324 | 6/1994 | (FR) . |
| 2 714 771 | 7/1995 | (FR) . |
| 2 233 155 | 1/1991 | (GB) . |
| 1 227 978 | 4/1986 | (SU) . |
| 92/00598 | 1/1992 | (WO) . |
| 92/05649 | 4/1992 | (WO) . |
| 94/00901 | 1/1994 | (WO) . |

* cited by examiner

CIRCUIT BREAKER ROTOR ASSEMBLY HAVING ARC PREVENTION STRUCTURE

BACKGROUND OF THE INVENTION

The present invention relates generally to rotor spring insulation, and, more particularly, to the prevention of the arcing of electrical current between a rotor connecting rod and a rotor spring in single- and multipole circuit breakers by increasing the amount of insulation on a rotor.

A current-limiting single-pole circuit breaker is generally a high current circuit interrupting device capable of substantially limiting the duration and the intensity of current destined to flow in a circuit experiencing a short circuit fault. To limit the duration and the intensity of short circuit currents, a circuit breaker must, within the shortest possible time, separate its contacts. This separation of the contacts is achieved by rapidly accelerating movable contact arms through an open gap. Upon the intense overcurrent conditions that result in the separation of the contacts, however, arcing often occurs between various parts in the circuit breaker. Arcing between the contacts is usually extinguished by passing the arc through an arc dissipating means. However, arcing may occur between other components of the circuit as well.

Rotary contact arrangements are typically rotatably arranged on a support shaft between the fixed contact arms of the single-pole circuit breaker and function to interrupt the flow of current in the event that a short circuit occurs. A rotary contact arrangement employs a rotor and a pair of rotor springs to maintain contact between the movable contact arms and the fixed contact arms, thus maintaining a good electrical connection between the contacts. The compression forces provided by the rotor springs must be overcome when the contacts become separated and the circuit "blows open" due to the occurrence of opposing electrodynamic repulsion fields between the movable contact aim and the fixed contact arm.

Because of the size restrictions on the sizes of components inside a single-pole circuit breaker casing, the rotor springs are usually situated proximate

DETAILED DESCRIPTION OF THE INVENTION

Figure 1:
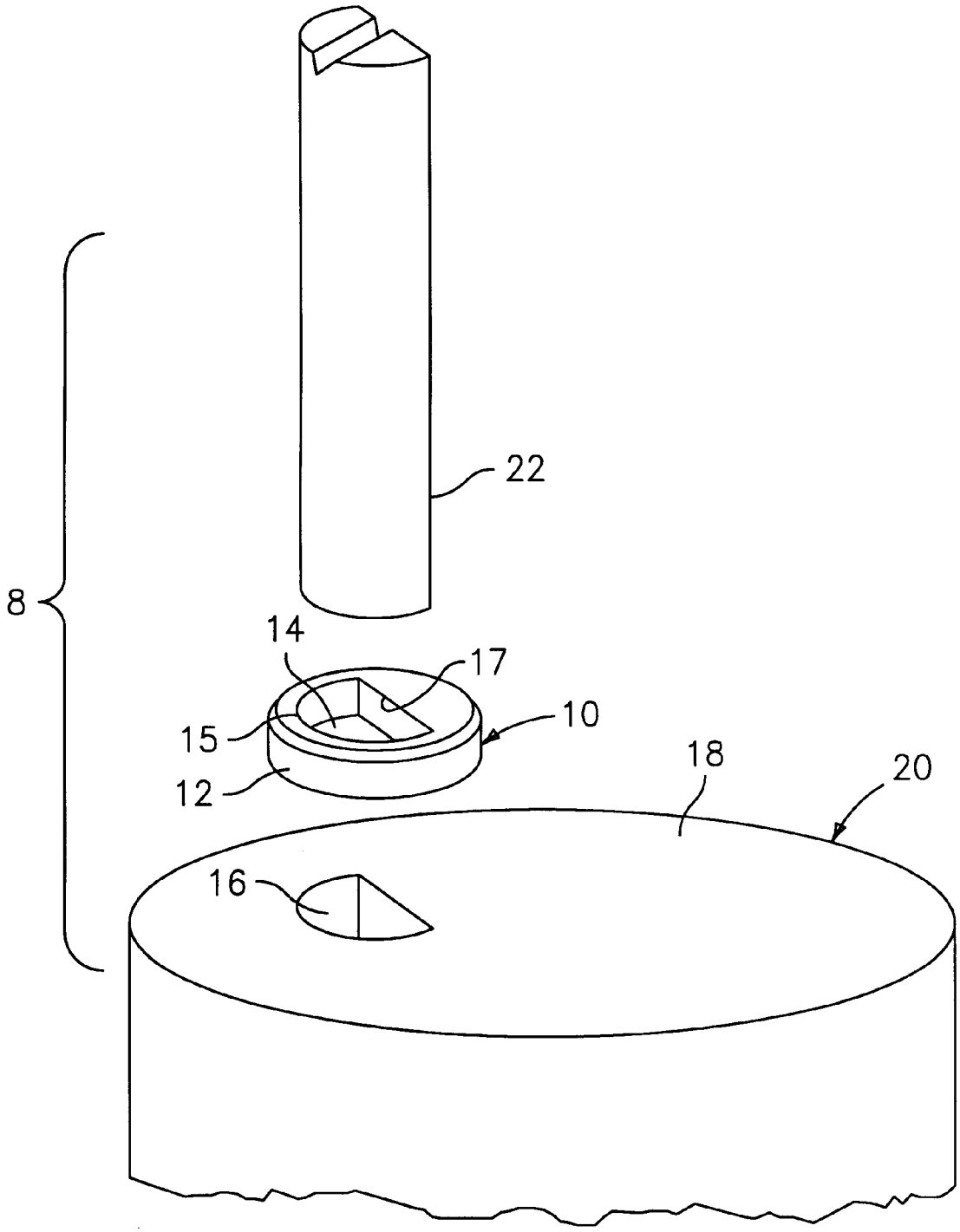
FIG. 1 is an exploded perspective view of a rotor spring insulator, a D-shaped connecting rod, and a rotor, of the present invention.

Referring to FIG. 1, a rotor 20 including a rotor spring insulator 10 is shown. Rotor spring insulator 10 is a substantially cylindrical structure having a D-shaped opening 14 formed by a rounded edge 15 and a flat edge 17. Rotor spring insulator 10 is fixedly secured to rotor 20 such that opening 14 is aligned with a hole 16 extending through rotor 20. Opening 14 and hole 16 accept a D-shaped connecting rod shown generally at 22. Rotor spring insulator 10 extends up from face 18 of rotor 20 and insulates a rotor spring (shown with reference to FIG. 5) from connecting rod 22 to prevent arcing between those two components, in the preferred embodiment, rotor 20 is molded from an insulative material, and rotor spring insulator 10 is integrally molded with rotor 20.

Hole 16 may be of any cross section capable of accommodating D-shaped connecting rod 22. In FIG. 1, hole 16 is of a D-shaped cross section and extends into and completely through rotor 20 to an opposing face of rotor 20. A second base member (not shown) having a D-shaped opening is fixedly secured to the opposing face of rotor 20. Base members 12, when secured or integrally molded with rotor 20, extend away from face 18 and the opposing face of rotor 20 to maximize the distance and the amount of insulative material between the spring and D-shaped connecting rod 22 disposed in hole 16. Typically, two holes are situated through rotor 20 to receive two D-shaped connecting rods 22 thereby requiring four rotor spring insulators 10.

Figure 2:
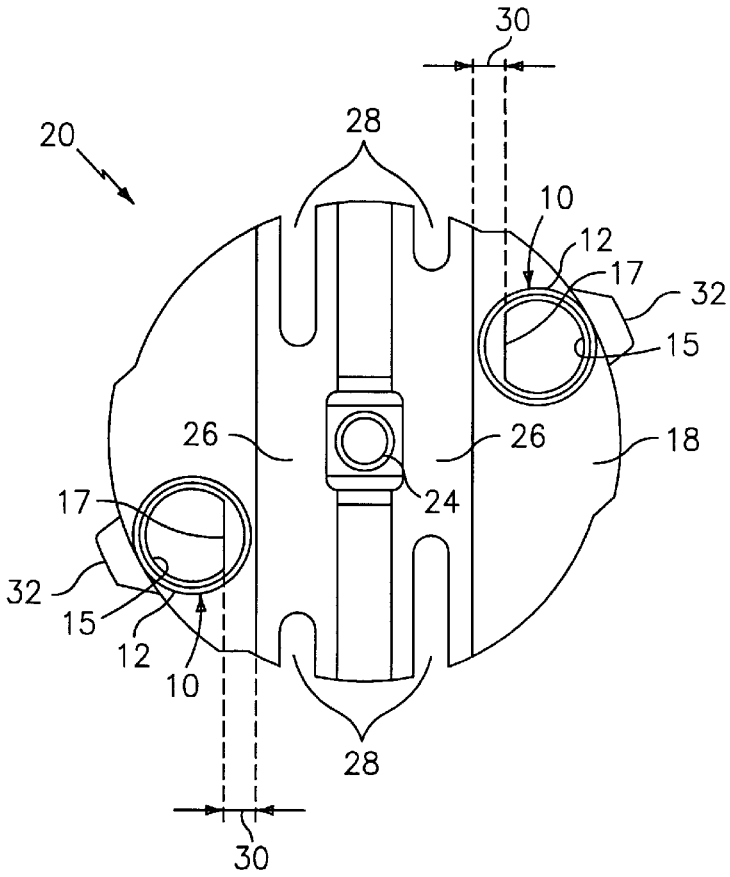
FIG. 2 is a plan view of the rotor and rotor spring insulators of FIG. 1.

In FIG. 2, face 18 of rotor 20 is shown in more detail. Rotor 20 is rotatably supported by a shaft 24, which is mounted inside an insulating enclosure in the form of a box (not shown). Two rotor spring insulators 10 are situated adjacent springs (not shown) positioned in grooves 26 on face 18. Grooves 26 contain slots 28 disposed lengthwise along grooves 26 for accommodating pins (not shown) to which the springs are mounted. Rotor spring insulator 10 is positioned on rotor 20 such that flat edge 17 is closer to groove 26 than rounded edge 15. This configuration maximizes a distance 30 between groove 26 and D-shaped opening 16.As a result, the electrical insulation between the springs that are positioned in grooves 26 and the D-shaped connecting rods 22 is maximized. Also shown are rotary contact arm bases 32, upon which a movable contact aim (not shown) may rest.

Figure 3:
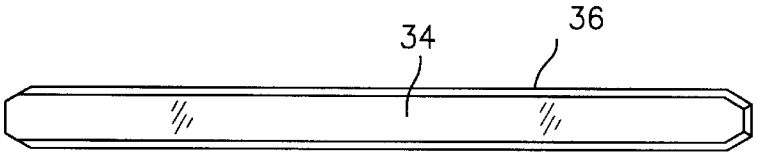
FIG. 3 is a perspective view of the D-shaped connecting rod of FIG. 1.
Figure 4:
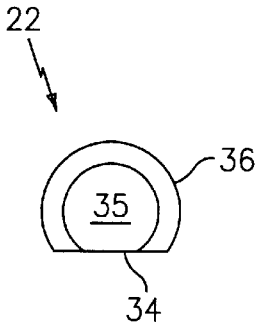
FIG. 4 is a front elevated view of the D-shaped connecting rod of FIG. 1.
Figure 5:
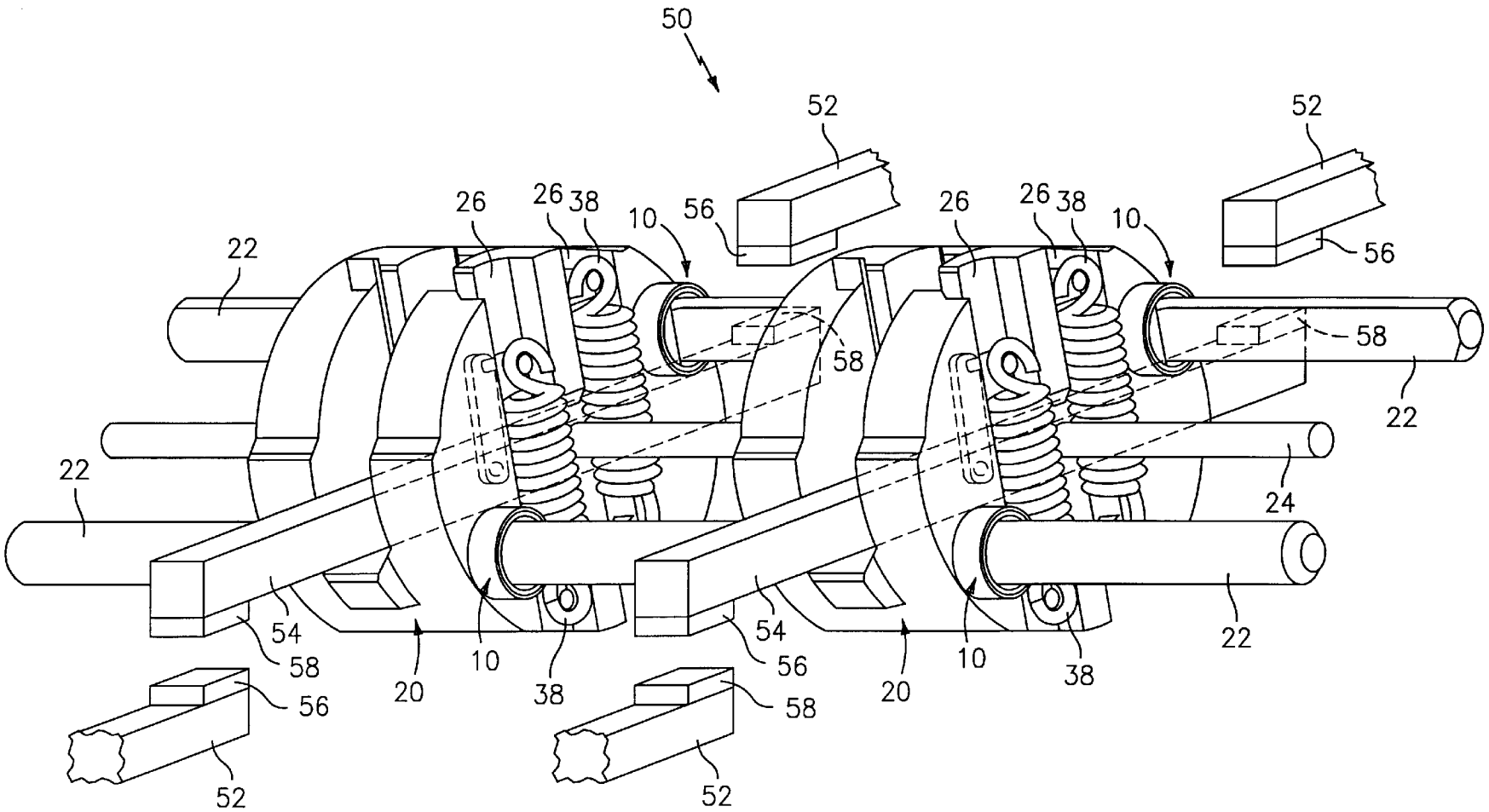
FIG. 5 is an isometric view of a circuit breaker including the rotor spring insulator, D-shaped connecting rod, and rotor of FIG. 1.

In FIGS. 3 and 4, D-shaped connecting rod is generally shown at 22. D-shaped connecting rod 22 is generally cylindrical in structure and is chamfered along a longitudinal axis, thus forming a flat side 34 opposite a rounded side 36. A cross sectional view of D-shaped connecting rod 22 is depicted in FIG. 4. Rounded side 36 and flat side 34 are dimensioned to mate with rounded edge 15 and flat edge 17 on rotor spring insulator 10. Chamfering to form flat edge 34 allows D-shaped connecting rod 22 to be snugly accommodated by rotor spring insulator 10 when D-shaped connecting rod 22 is inserted into D-shaped opening 14. Positioning of flat edge 34 closer to grooves 26 maximizes distance 30. In an alternate embodiment, rotor spring insulator 10 may have a square hole for accommodating a connecting rod 22 of a square cross section, FIG. 5 is an isometric view of a circuit breaker 50 including rotor spring insulators 10, D-shaped connecting rods 22. Rotors 20 are rotatably arranged on support shaft 24 between fixed contact arms 52 of the circuit breaker 50. Rotor spring insulator 10 is shown on rotor 20 with springs 38 laid in grooves 26. In the preferred embodiment, springs 38 are coil springs fabricated from music wire free from scale and burrs and arc of a true helical shape. Each spring 38 is connected with a movable contact arm 54. Springs 38 are configured to allow contacts 54 disposed on the movable contact arm 54 to be engaged with contacts 56 disposed on the fixed contact arm 52 while spring 38 is tensioned thus maintaining an electrical connection between contacts 54 and 56.

During an overcurrent condition, opposing electrodynamic repulsion fields are generated, and the movable contact arm 54 is magnetically urged away from the fixed contact arm 52. D-shaped connecting rods 22 cooperatively link a series of rotors 20 to form a multipole circuit breaker When any one of the movable contact arms 54 is "blown open" because of an overcurrent condition, and the rotor 20 is rotated on the support shaft 24, the points of contact between the movable contact arms 54 and their respective fixed contact arms 52 are broken. Because the connecting rods 22 link the single-pole units into a multipole unit, both sets of contacts 54 and 56 in each of the linked units are separated.

Because of the intense conditions in a "blown open" circuit, arcing occurs between the electrically conductive components inside the circuit breaker. Rotor spring insulators 10, in conjunction with D-shaped connecting rod 22, maximize the distance between D-shaped connecting rod 22 and spring 38. As a result, the chance that arcing will occur between the connecting rod 22 and spring 38 is reduced from that in circuit breakers of the prior art.

SUMMARY OF THE INVENTION

In an exemplary embodiment of the invention, a circuit breaker assembly comprises a rotor supporting a rotary contact arm, an insulator having a shaped opening therethrough, and a connecting rod having a shaped cross section configured and dimensioned to be received in the shaped opening of the insulator. The assembly further comprises a rotor spring supported on the rotor and cooperatively connected to the rotary contact arm. The shaped opening of the insulator has a flat edge positioned to be generally parallel to a longitudinal axis of the rotor spring. Positioning the flat edge of the connecting rod to face the rotor spring, as opposed to positioning the rotor spring insulator assembly so that a rounded edge of the connecting rod faces the rotor spring, increases the distance between the connecting rod and the rotor spring. Increasing this distance provides insulative properties to the rotor thereby minimizing the chances that arcing will occur between the connecting rods and the rotor springs of a single- or multipole circuit breaker. Connecting rods having other cross sectional shapes, e.g., a square cross section, may be utilized.

What is claimed is:

1. A circuit breaker comprising:

a generally cylindrical rotor rotatable about an axis, said rotor includes a radial surface and opposing side surfaces, said rotor further includes an insulator extending from one of said opposing side surfaces;

a spring proximate said side surface of said rotor, said spring having a longitudinal axis extending in a plane generally perpendicular to said axis of said rotor; and a connecting rod having a shaped cross section, said connecting rod extending through a shaped opening disposed in said insulator and a hole disposed in said rotor.

2. The circuit breaker assembly of claim 1 wherein said insulator is integrally molded to said one of said opposing side surfaces.

3. The circuit breaker assembly of claim 1 wherein said shaped opening comprises a D-shaped opening and said shaped cross section comprises a D-shaped cross section.

4. The circuit breaker assembly of claim 1 wherein said insulator is a generally cylindrical structure extending from said one of said opposing side surfaces.

5. The circuit breaker assembly of claim 1, wherein said rotor further includes a groove extending along said one of said opposing side surfaces, said groove receiving said spring.

* * * * *